US008702095B2

(12) United States Patent
Shin et al.

(10) Patent No.: US 8,702,095 B2
(45) Date of Patent: Apr. 22, 2014

(54) APPARATUS FOR PULLING BILLS AND CHECKS IN BUNDLE BILL AND CHECK ACCEPTOR

(75) Inventors: Kyung Joo Shin, Seoul (KR); Woo Ho Lee, Seoul (KR); Jin Hwan Cha, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 13/597,078

(22) Filed: Aug. 28, 2012

(65) Prior Publication Data

US 2013/0049282 A1 Feb. 28, 2013

(30) Foreign Application Priority Data

Aug. 30, 2011 (KR) ..... 10-2011-0087090

(51) Int. Cl.
*B65H 5/00* (2006.01)

(52) U.S. Cl.
USPC ..... 271/225; 271/85; 271/204

(58) Field of Classification Search
USPC ..... 271/225, 184, 185, 198, 199, 204, 206, 271/207, 82, 85
See application file for complete search history.

(56) References Cited

U.S. PATENT DOCUMENTS

| | | | | |
|---|---|---|---|---|
| 3,965,913 A | | 6/1976 | Tokura et al. | |
| 5,027,993 A | * | 7/1991 | Ferguson | 226/74 |
| 6,991,229 B2 | * | 1/2006 | Yamakawa et al. | 271/223 |
| 8,113,508 B2 | * | 2/2012 | Onodera et al. | 271/209 |
| 2007/0007707 A1 | | 1/2007 | Abe et al. | |
| 2009/0171499 A1 | * | 7/2009 | Afanasov et al. | 700/215 |
| 2010/0059586 A1 | | 3/2010 | Lee et al. | |

FOREIGN PATENT DOCUMENTS

| | | | | |
|---|---|---|---|---|
| CA | 2599775 | | 2/2009 | |
| GB | 2403840 | | 1/2005 | |
| JP | 2004107079 A | * | 4/2004 | B65H 29/40 |
| KR | 10-2006-0081761 A | | 7/2006 | |
| KR | 10-0838605 A | | 6/2008 | |
| KR | 10-2010-0030085 A | | 3/2010 | |
| KR | 10-2011-0078203 A | | 7/2011 | |
| WO | WO 2009/0148205 A1 | | 12/2009 | |

OTHER PUBLICATIONS

Extended Search Report for European Patent Application No. 12182329.8, Feb. 21, 2013, 8 Pages.

* cited by examiner

*Primary Examiner* — Michael McCullough
(74) *Attorney, Agent, or Firm* — Fenwick & West LLP

(57) ABSTRACT

An apparatus for pulling a paper medium, e.g., a bill or a check in a bundle bill and check acceptor includes a transfer roller unit transferring the paper medium that is vertically introduced into a storage cassette, a transfer belt unit provided to be rotated so that the paper medium that has passed through the transfer roller unit is horizontally transferred to a rear of the storage cassette, and a clamping roller unit having first and second elastic clamps. Each of the clamps is configured to clamp and pull the front end of the paper medium, and release the paper medium at the rear of the storage cassette depending on rotation of the transfer belt unit, so that the paper medium is stacked in the storage cassette.

4 Claims, 5 Drawing Sheets

APPARATUS FOR PULLING BILLS AND CHECKS IN BUNDLE BILL AND CHECK ACCEPTOR

RELATED APPLICATION

This application claims the benefit of Korean Patent Application No. 10-2011-0087090, filed on Aug. 30, 2011, which is hereby incorporated by reference as if fully set forth herein.

FIELD OF THE INVENTION

The present invention relates to a bill and check acceptor, and more particularly, to an apparatus for pulling a bill or a check in a bundle bill and check acceptor in which combined bills and checks are deposited in a bundle rather than depositing one after another, capable of clamping a front end of a bill or check, transferring the bill or check to a desired position of a storage cassette, and allowing the bill or check to free fall down the storage cassette so that the bill or check is stacked in the storage cassette.

BACKGROUND OF THE INVENTION

Generally, financial automated apparatuses such as CDUs (Cash Dispenser Units) or BRMs (Bill Recycling Machines) have been developed to rapidly and conveniently provide the majority of financial services other than a face-to-face service in an unmanned manner regardless of the time. Such financial automated apparatuses are typically referred to as ATMs (Automated Teller Machine).

ATMS are imparted with functions for providing a variety of financial services as well as a cash deposit/withdrawal function. For this, ATMs may include different kinds of additional units, such as a card processing unit, a bankbook processing unit, and a check deposit unit.

In the case of cash, depending on the face value, the sizes and shapes of bills may vary, while bills of the same face value have generally the same size and shape. Thus, ATMs can accept a predetermined number of bills in a bundle. However, unlike bills, checks have a variety of characters printed thereon using a specific magnetic ink. A check acceptor reads characters, such as the serial number, printed on a check using a MICR (Magnetic Ink Character Reader) and then processes the deposit of the check.

The check acceptor generally includes an introduction unit which accepts a check, a check alignment unit which aligns the introduced check in a predetermined position, a transfer unit which transfers the aligned check, an MICR unit which reads information on the check, a printing unit that prints a character string onto the rear surface of the check, and a storage unit which sequentially stacks and stores checks that have been subjected to a deposit process.

In the check acceptor configured as above, unlike the automated bill deposit/withdrawal function of the ATM that accepts a bundle of a predetermined number of bills using the introduction unit, checks should be oriented in a specific direction and introduced into the introduction unit one after another so that the checks can be transferred along a predetermined transfer path and stored in the storage unit. That is, a check must be introduced into the introduction unit in a preset orientation in order for a check transfer operation to be able to be carried out. Moreover, there are a limited number of checks that can be introduced.

Therefore, a lot of checks should be inserted into the check acceptor over several times, causing the check deposit transaction to be time-consuming, and inconveniencing the user.

Furthermore, although all checks may be the same size in a certain country, a personal check personally issued and a business check issued by a corporation may be generally different from each other in their sizes. Therefore, the check acceptor cannot process checks of different sizes.

In an effort to overcome the above problems, a bulk check acceptor was proposed in U.S. Patent Application Publication No. 2010/0059586, published on Mar. 11, 2010, which is commonly assigned to the Applicant of the present invention and which is incorporated by reference herein in its entirety. This bulk check acceptor can accept checks in a bundle regardless of the size of the checks or an orientation in which the checks are input into the bulk check acceptor. Further, components are efficiently arranged, thus increasing convenience of use, and achieving a compact design.

However, a bill acceptor which can accept only bills in a bundle and a check acceptor which can accept only checks in a bundle are separately provided, thus inconveniencing users, and requiring a lot of installation space. Given purchase cost as well as the above disadvantageous factors, a combination of the bill acceptor and the check acceptor is strongly required.

Further, even though combined bills and checks having different sizes are introduced in bundle, the bundle needs to be dropped and deposited at a desired position in a storage cassette of the bill acceptor and the check acceptor, without incurring a jam.

SUMMARY OF THE INVENTION

In view of the above, therefore, the present invention provides an apparatus for pulling a bill or a check in a bundle bill and check acceptor, capable of clamping a front end of the bill or check, transferring the clamped bill or check to a desired position of a storage cassette in the bundle bill and check acceptor, and then allowing the transferred bill or check to free fall down the storage cassette so that the bill or check is stacked in the storage cassette.

Further, the present invention provides an apparatus for pulling a bill or a check in a bundle bill and check acceptor, capable of capable of accepting combined bills and checks in a bundle regardless of the size or orientation of the checks rather than requiring that checks be introduced one after another in a specific orientation.

Embodiments relate to an apparatus and a method for pulling a paper medium, e.g., a bill or check in a bundle bill and check acceptor. In embodiments, an apparatus for pulling a paper medium installed in a storage cassette of a bundle bill and check acceptor includes: a transfer roller unit transferring a paper medium that is vertically introduced into an inlet port of the storage cassette; a transfer belt unit provided to be rotated so that the paper medium that has passed through the transfer roller unit is horizontally transferred to a rear of the storage cassette; a clamping roller unit provided to clamp a front end of the paper medium depending on rotation of the transfer belt unit; and first and second elastic clamps provided on the transfer belt unit at positions spaced apart from each other by a predetermined distance, each of the first and second elastic clamps being configured such that a front end thereof is open when passing through the clamping roller unit and then clamps and pulls the front end of the paper medium that has been vertically introduced, and the elastic clamp releases the paper medium at the rear of the storage cassette so that the paper medium is stacked on the top of another in the storage cassette.

In the embodiments, the apparatus further includes a separation stopper provided on the transfer belt unit, wherein the separation stopper collides with the front end of the paper medium that is released at the rear of the storage cassette so that the paper medium free falls down the storage cassette.

In the embodiments, the apparatus further includes a stack wheel provided on the transfer belt unit, wherein the stack wheel strikes a rear end of the paper medium that has been clamped and is being transferred, so that the medium falls down the storage cassette.

In the embodiments, when the paper medium is clamped by either the first or second elastic clamp, a subsequent paper medium is standing by on the transfer roller unit.

In the embodiments, a plurality of holes are formed at regular intervals on the transfer belt unit, and the apparatus further includes a prism sensor unit provided in associated with the holes to control each of the elastic clamps to be disposed at a predetermined position of the clamping roller unit in which the paper medium is clamped by the elastic clamp.

In the embodiments, the apparatus further includes a detecting sensor provided between the transfer roller unit and the clamping roller unit, the detecting sensor detecting the entrance of the paper medium.

In the embodiments, a method of pulling a paper medium, e.g., a bill or check, in a storage cassette of a bundle bill and check acceptor, includes: detecting the paper medium transferred to an inlet port of the storage cassette; allowing the detected paper medium to temporarily stand by; allowing a speed at which a transfer belt rotates to reduce when the transfer belt is approach to a predetermined position in which the paper medium is to be clamped; stopping the transfer belt when the transfer belt is arrived at the predetermined position; transferring the paper medium that has been standing by to the clamping roller unit so that the paper medium is clamped by the clamping roller unit; and operating the transfer belt so that the paper medium clamped by the clamping roller unit is transferred and stacked into a medium storage cassette.

In the embodiments, the method further includes transferring a subsequent paper medium to be introduced into the inlet port while the paper medium clamped by the transfer belt is being transferred.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Hereinafter, embodiments of the present invention will be described in detail with reference to the accompanying drawings so that they can be readily implemented by those skilled in the art.

Figure 1:
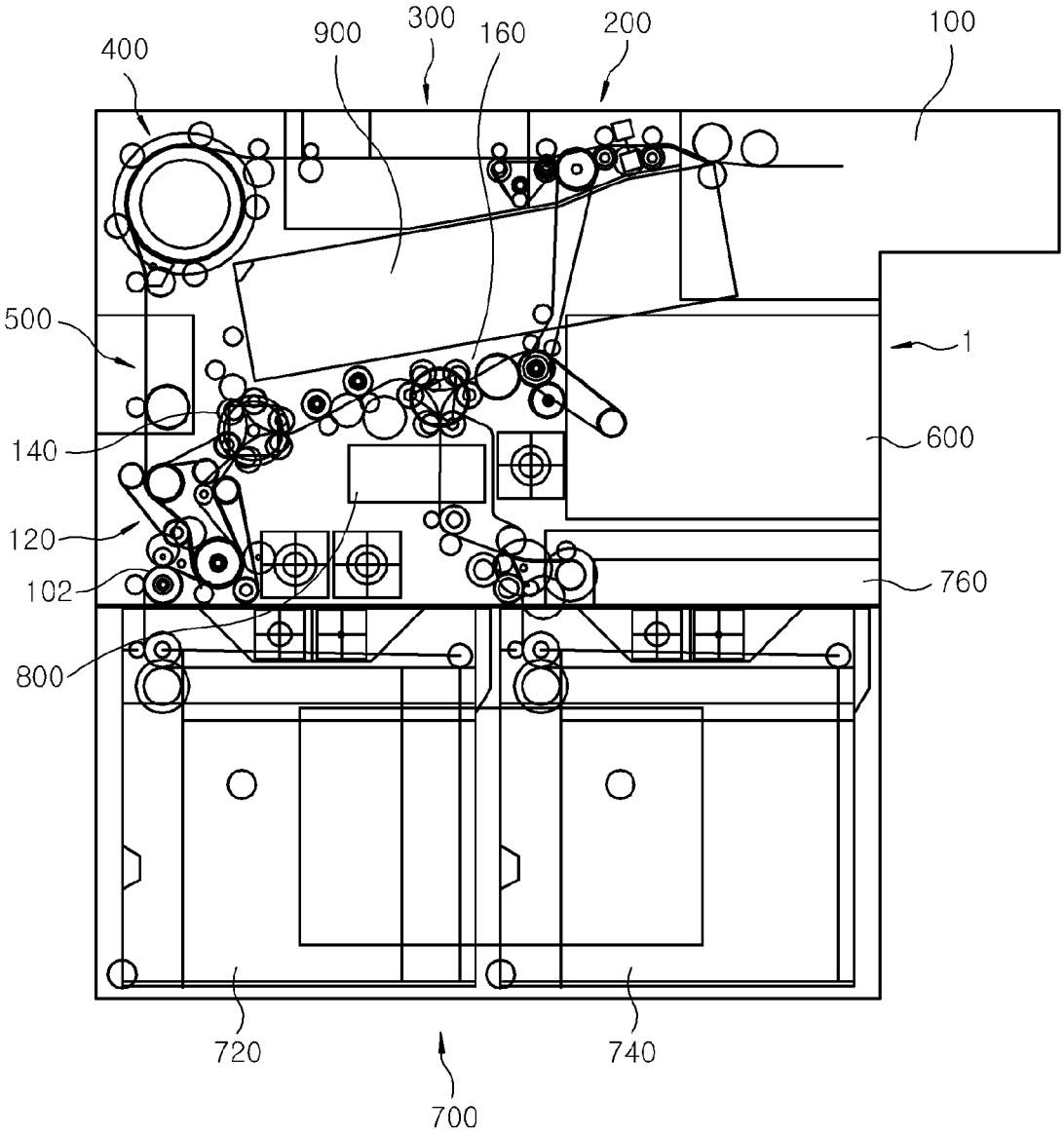
FIG. 1 is a schematic sectional view illustrating a bundle bill and check acceptor having an apparatus for pulling a paper medium in accordance with an embodiment of the present invention.

FIG. 1 is a schematic sectional view illustrating a bundle bill and check acceptor having an apparatus for pulling a paper medium in accordance with an embodiment of the present invention.

As shown in FIG. 1, a bundle bill and check acceptor of an embodiment includes a bundle receiving module 100 which is provided on a front and upper portion of a rectangular parallelepiped acceptor body 1. The bundle bill and check acceptor further includes a transfer module 200, a bill checker module 300 and an alignment module 400 which are disposed behind the bundle receiving module 100 and are sequentially arranged in the acceptor body 1. The bundle bill and check acceptor further includes a recognition module 500 which is disposed right below the alignment module 400, an escrow module 600 which is level with the recognition module 500 and is disposed on a front surface of the main acceptor body 1, and a print module 800 which is disposed between the recognition module 500 and the escrow module 600. The bundle bill and check acceptor further includes a reject module 900 which is disposed in a central portion of the acceptor body 1, and a cassette unit 700 which is disposed in a lower portion of the acceptor body 1 and separately receives bills and checks. The above-mentioned modules are compactly configured in the acceptor body 1.

Although it is not shown in detail in the drawings, the bundle receiving module 100 is disposed on an upper portion of the front surface of the acceptor body 1, as viewed in the side of the acceptor. The bundle receiving module 100 may include an inlet shutter which will be opened by driving a pulse motor, and an introduction unit which draws and transfers a plurality of individual bills and checks, e.g., a bundle of a maximum of fifty combined bills and checks, into the bundle bill and check acceptor at low speed by driving a transfer motor that clamps and transfers them. The bundle receiving module 100 also includes a separation unit which separates and transfers the bundle of bills and checks drawn in the introduction unit one after another, and a discharge unit. In operation, the combined bills and checks drawn in a bundle from the introduction unit are transferred to the separation unit, a bill press of the separation unit moves upwards and pressurizes the bundle of combined bills and checks transferred thereto, and then the separation unit rotates and separates the bundle of combined bills and checks one after another using frictional force. Each bill or check that has been separated from the bundle is transferred to the transfer module 200 that is disposed behind the bundle receiving module 100.

Hereinafter, for the sake of simple explanation, bill and/or check will be collectively referred to as a paper medium.

The transfer module 200 finally monitors, using an ultrasonic sensor and a hall sensor, whether or not each paper medium that has been separated from the bundle by the bundle receiving module 100 is of two or more leaves overlap one above another, and then transfers the separated paper medium. The bill checker module 300 discriminates the authenticity of the separated paper medium that is being transferred after monitoring of the two or more overlap leaves and checks an image of the paper medium to determine whether the paper medium is abnormal or not. At this time, the size of the paper medium, and particularly, if it is a check, information about an introduced position of an endorsement surface of the check are verified.

The paper medium that has passed through the bill checker module 300 is introduced into the drum type alignment module 400 on a leaf-by-leaf basis. The paper medium is aligned based on right edge thereof in the alignment module 400. The recognition module 500 may include an MICR (Magnetic Ink Character Reader) and a CIS (Contact Image Sensor). The recognition module 500 is placed almost upright in a rear end of the main acceptor body 1. The MICR reads the serial number and the like printed on each check. After reading, the check is transferred to the escrow module 600.

The escrow module 600 has a shape of a tape reel. The escrow module 600 is level with the recognition module 500 and is disposed in the front end of the main acceptor body 1. Furthermore, a plurality of paper media, e.g., mixed up to fifty, a bundle of paper media are escrowed by the escrow module 600 in the same manner as that of a tape.

After the respective paper media have been escrowed, images of the paper media that have been scanned by the recognition module 500 using the CIS unit may be displayed to a user or a customer. The user monitors the state of the paper media and issues a request that the paper media introduced into the acceptor body 1 be processed.

For instance, when the user requests the bundle bill and check acceptor to deposit all of the displayed paper media, e.g., checks all at once or to selectively deposit some of the displayed checks, the escrowed checks are separated and selected one after another, and the selected check is then transferred to the print module 800 located between the recognition module 500 and the escrow module 600.

The print module 800 may include an ink unit which has an endorsement function. For performing the endorsement function, the bundle bill and check acceptor may conduct a turning upside down function, which will be explained later herein, depending on the orientation of a check introduced into the bundle receiving module 100, thus allowing a character string to be printed on the endorsement surface of the check. The endorsed check is then transferred to the cassette unit 700.

The reject module 900 is disposed in the central portion of the main acceptor body 1. Among a bundle of combined media introduced into the bundle bill and check acceptor, a damaged or unrecognizable bill and check, which needs to be rejected, and a bill or check, which was escrowed in the escrow module 600 but requested for a deposit cancel from the user, may be transferred in a bundle by the reject module 900 into the returning unit of the receiving module 100.

The bundle bill and check acceptor further includes a U-shaped transfer path 120 disposed below the recognition module 500, and first and second 3-way switching gates 140 and 160 that are sequentially provided on the transfer path between the recognition module 500 and the escrow module 600.

The first 3-way switching gate 140 is switched such that a rejected paper medium recognized by the recognition module 500 is transferred to the reject module 900, or a paper medium escrowed in the escrow module 600 is transferred to the reject module 900 in response to a deposit cancel request from the user, or a paper medium escrowed in the escrow module 600 is transferred to the cassette unit 700 in response to a deposit approval request from the user.

The second 3-way switching gate 160 is switched such that each normal paper medium escrowed in the escrow module 600 is transferred to the cassette unit 700 via the first 3-way switching gate 140 and the U-shaped transfer path 120, or if the endorsement surface of each check escrowed in the escrow module 600 is oriented in the correct direction, the escrowed check is transferred to the print module 800, or otherwise, the escrowed check is transferred to the transfer path between the first and second 3-way switching gates 140 and 160 before being transferred to the print module 800. It can be determined whether the endorsement surface of each escrowed check is oriented in the correct direction by checking the introduced position of the endorsement surface of the check transferred from the bill checker module 300. Furthermore, the second 3-way switching gate 160 is used to transfer a paper medium that has been determined to be counterfeit into a retraction box 760.

The retraction box 760 separately stores a retraction paper medium of the rejected paper medium discharged to the bundle receiving module 100 by the reject module 900, and a counterfeit paper medium detected by the recognition module 500. In this embodiment, the retraction box 760 is disposed between the escrow module 600 and a bill or check storage cassette 720 or 740 of the cassette unit 700, which will be discussed below. The bundle bill and check acceptor of the embodiment complies with the regulations of Article 6, of the European Central Bank that requires that counterfeit bills and checks be stored in a separate storage location.

An operation of the bundle bill and check acceptor of the embodiment having the above-mentioned construction will now described as follows.

In a deposit calculation mode, a bundle of combined bills and checks is introduced into the bundle receiving module 100. The introduced bundle sequentially passes the transfer module 200, the bill checker module 300, the alignment module 400, the recognition module 500, the U-shaped transfer path 120 and the first and second 3-way switching gates 140 and 160 and then is escrowed in the escrow module 600.

A damaged or unrecognizable bill or check that is detected by the bill checker module 300 and needs to be rejected is discharged from the U-shaped transfer path 120 to the bundle receiving module 100 via the reject module 900.

In the case of a counterfeit bill or check that is detected by the bill checker module 300, the transfer path thereof is switched towards the reject module 900 by the second 3-way switching gate 160 so that the counterfeit bill or check can be separately received in the retraction box 760.

In the bundle bill and check acceptor of the embodiment, when the escrow module 600 conducts the escrow function, the rejected bills or checks, counterfeit bills or checks and normal bills or checks are separated by the 3-way switching gates and separately stacked one on top of another. In such an escrow state, after receiving confirmation from the user, the bills or checks are bulk-processed depending on the reception of deposit approval or deposit cancel.

Figure 2:
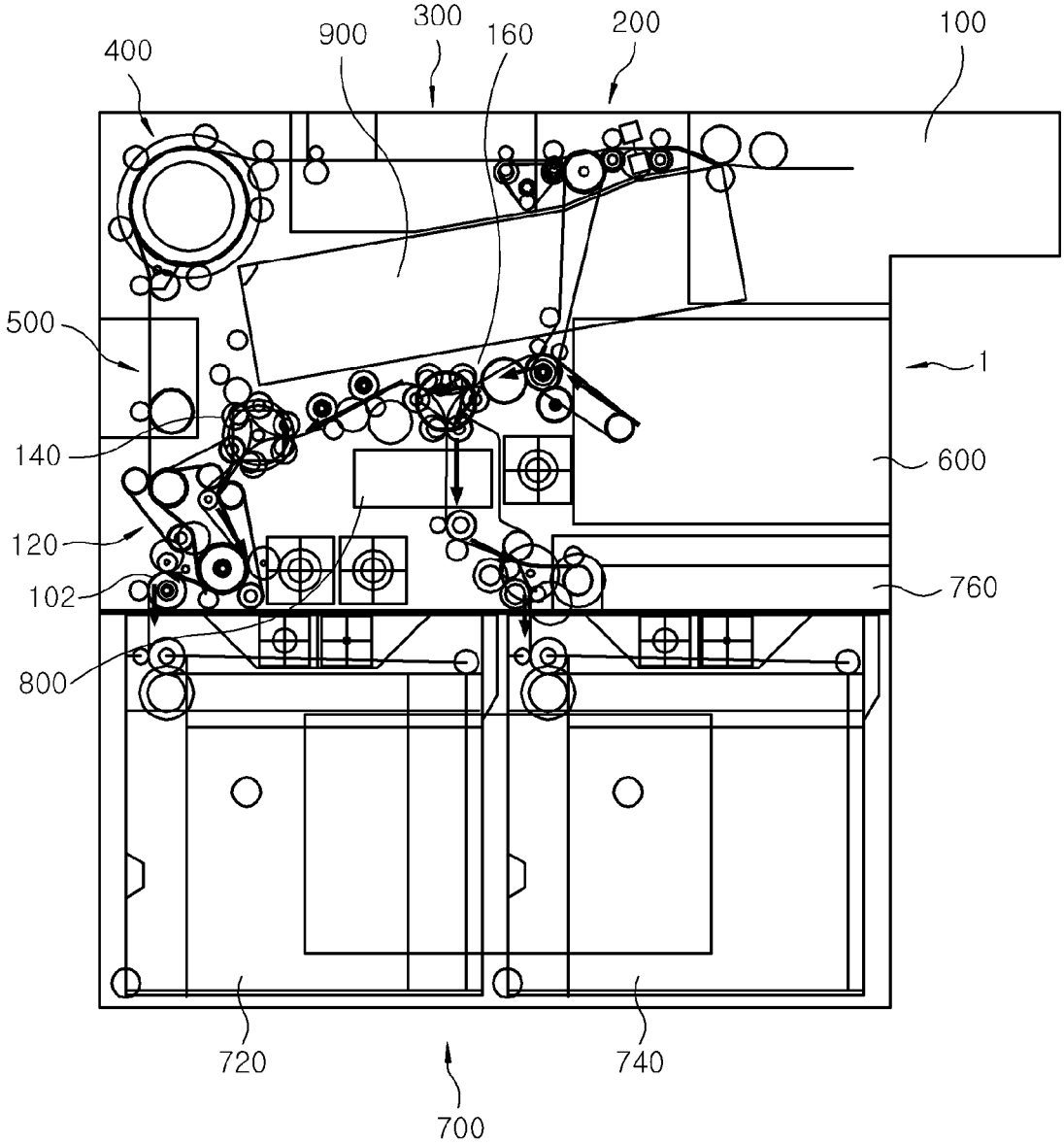
FIG. 2 illustrates a transfer path of a paper medium at a deposit approval in the bundle bill and check acceptor.

For example, in a state that the normal bills are escrowed in the escrow module 600, if the user requests the bundle bill and check acceptor to make the deposit, the normal bills are received into the bill storage cassette 720 via the second and first 3-way switching gates 160 and 140, the U-shaped transfer path 120, and a switching gate 102 disposed between the U-shaped transfer path 120 and the bill storage cassette 720, as shown in FIG. 2.

In the case of checks, if an endorsement surface of the check was oriented and verified in the correct direction by the bill checker module 300, the check is directly transferred from the bill checker module 300 to the print module 800 by the second 3-way switching gate 160, and is endorsed, and then is received into the check storage cassette 740.

Otherwise, if an endorsement surface of the check was disoriented in the correct direction, the check is transferred from the bill checker module 300 to the first 3-way switching gate 140 by the second 3-way switching gate 160, and is turned upside down such that the orientations of the sides of the check are changed with each other, and then sent to the print module 800. Subsequently, the check is endorsed in the print module 800 and then received into the check storage cassette 740.

Meanwhile, referring back to FIG. 1, the cassette unit 700 includes the bill storage cassette 720 which stores normal bills, and the check storage cassette 740 which stores normal checks, as well as the retraction box 270. In this embodiment, the structure of the bill storage cassette 720 is the same as that of the check storage cassette 740. In the bundle bill and check acceptor as shown in FIG. 1, the bill storage cassette 720 is disposed at the left position, and the check storage cassette 740 is disposed on the right side of the check storage cassette 740. The bill storage cassette 720 and the check storage cassette 740 are adjacent to and are lined up with each other, and are removably installed in the acceptor body 1. It is understood that the bill storage cassette 720 and the check storage cassette 740 may switch positions.

Figure 3:
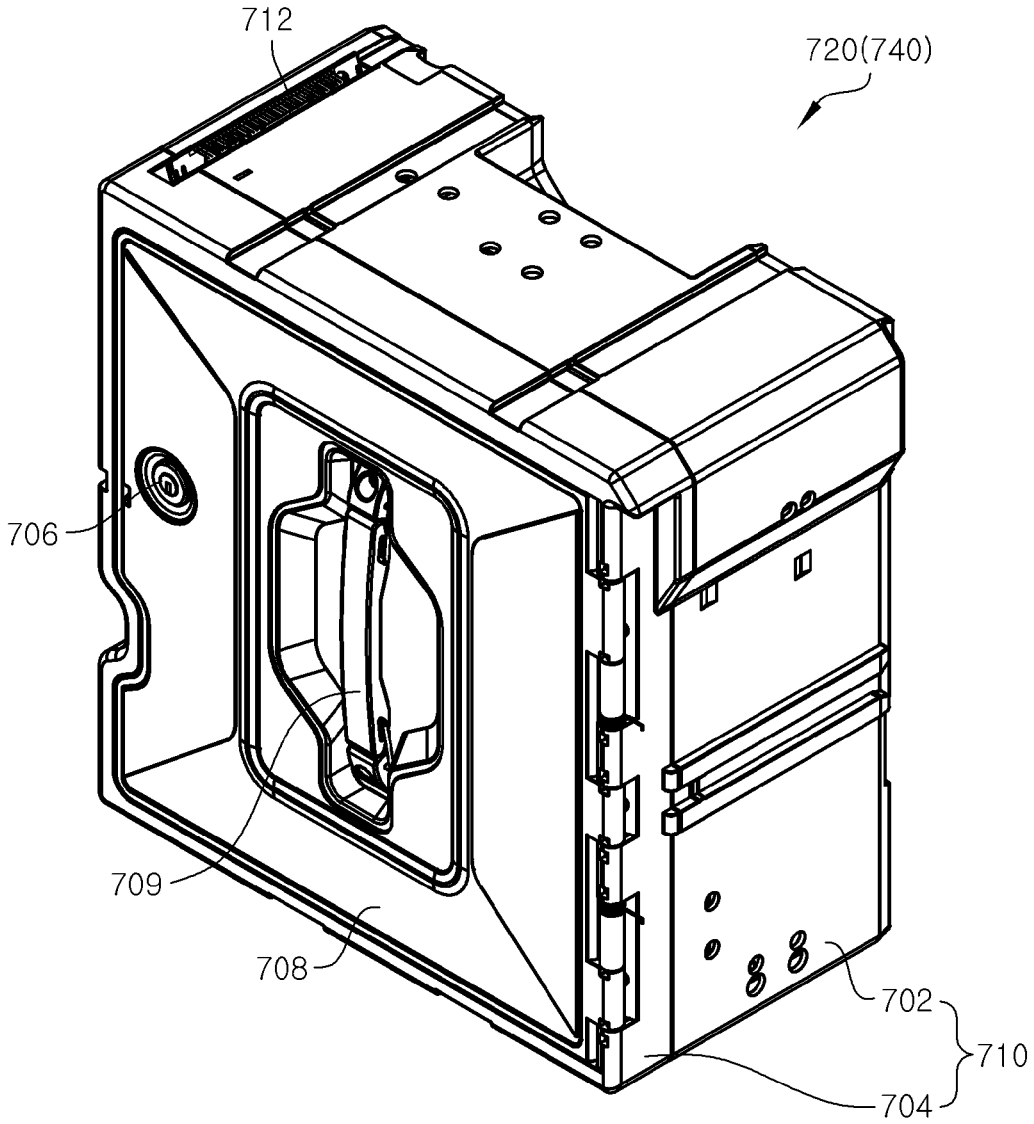
FIG. 3 is a perspective view of a storage cassette arranged to be removable to the bundle bill and check acceptor.
Figure 4:
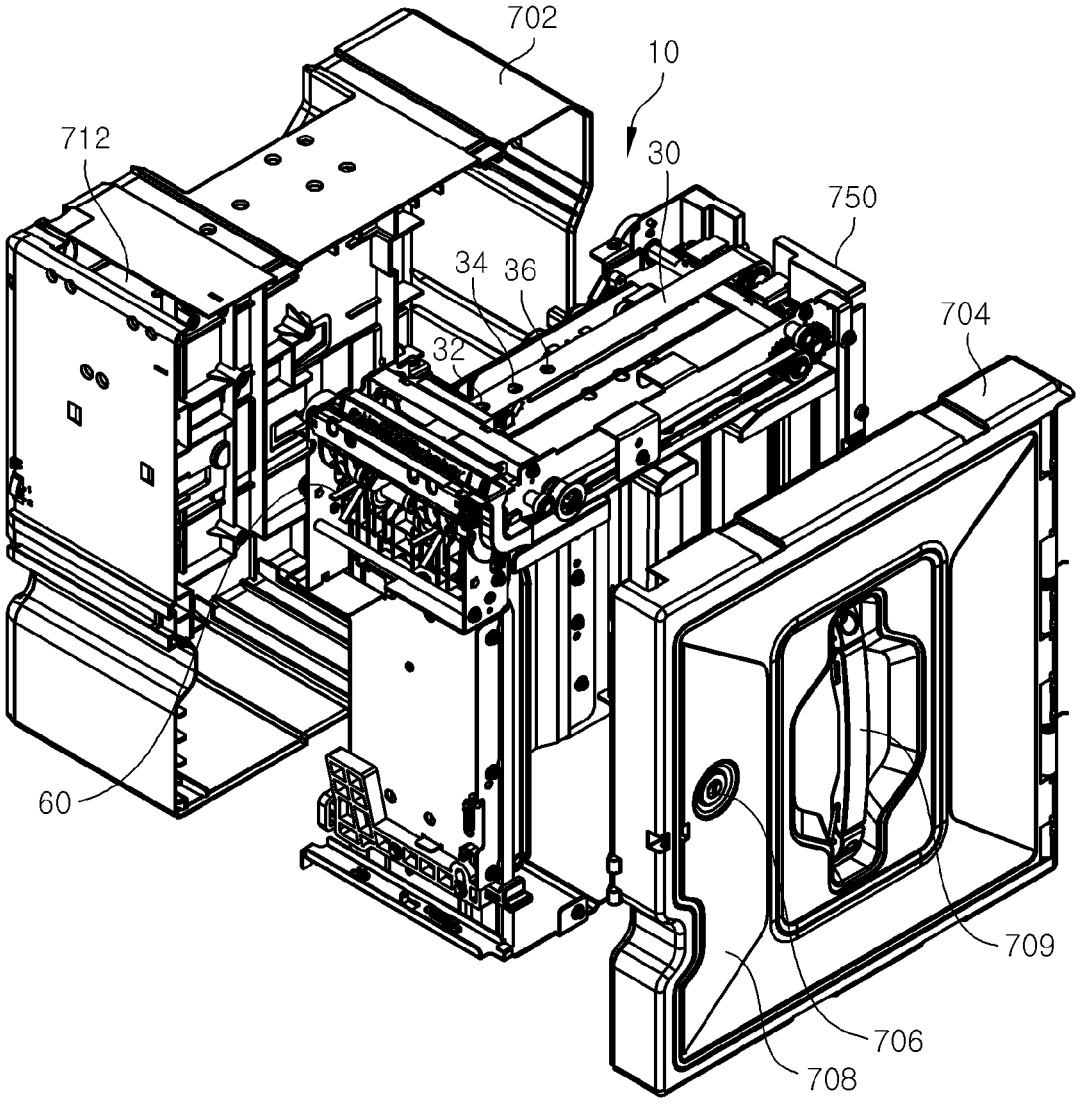
FIG. 4 illustrates an exploded perspective view of the storage cassette shown in FIG. 3.

FIG. 3 is a perspective view of the bill storage cassette or the check storage cassette, and FIG. 4 is an exploded perspective view of the bill storage cassette or the check storage cassette shown in FIG. 3.

As shown in FIGS. 3 and 4, a storage cassette, e.g., the check storage cassette 740 includes a casing body 710 and a cassette module 750 installed inside the casing body 710. The casing body 710 includes a rear surface part 702 and a front surface part 704 which are coupled to each other to form a rectangular parallelepiped shape.

A door 708 is provided in the front surface part 704 and is opened or closed depending on the operation of a locking device 706, and a handle 709 is provided on the door 708.

An inlet port 712 is formed in an upper surface of the casing body 710 so that the paper medium can be vertically introduced through it.

Figure 5:
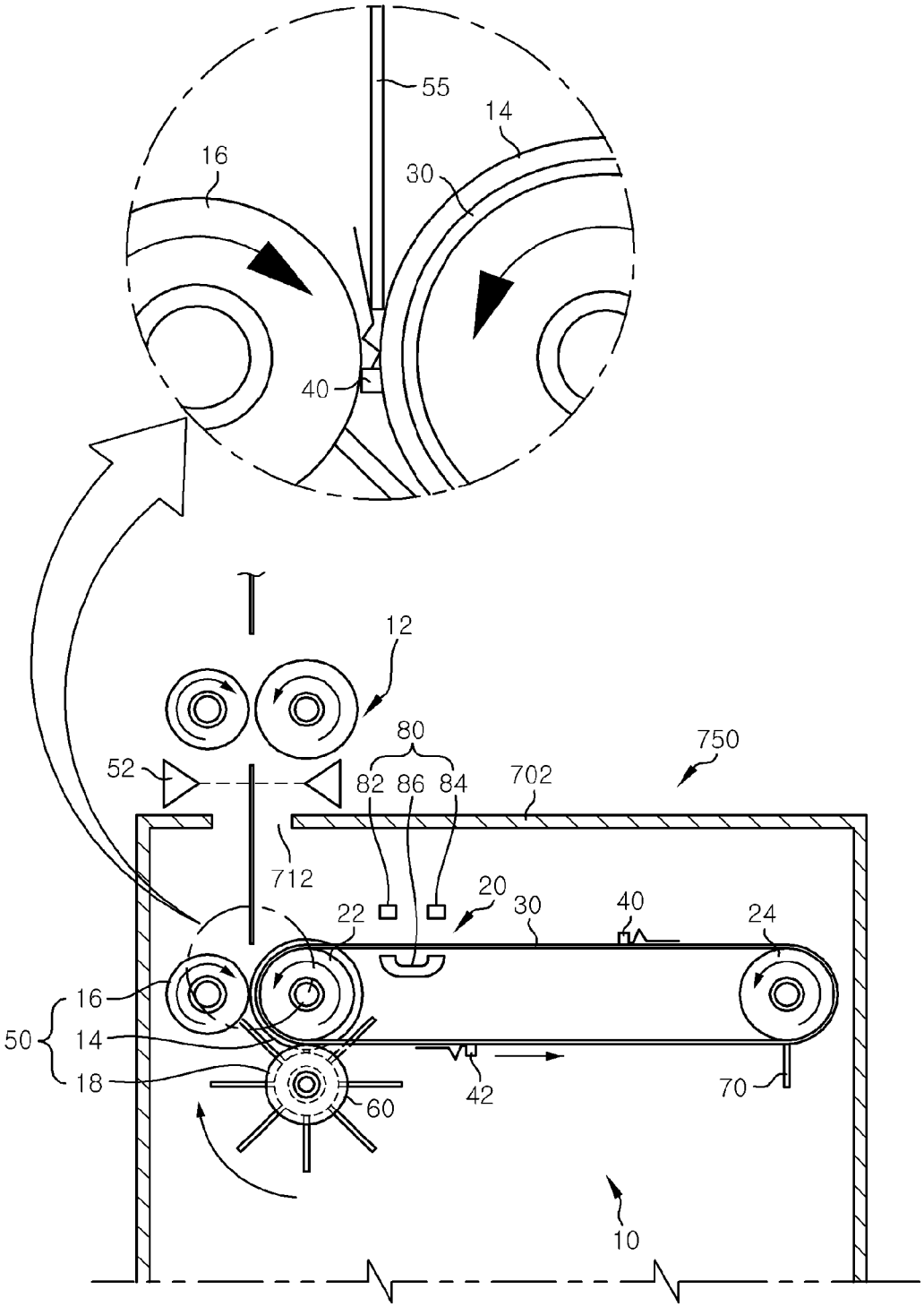
FIG. 5 is a schematic diagram illustrating the operation of the apparatus in accordance with an embodiment of the present invention.

FIG. 5 is a schematic diagram illustrating the operation of an apparatus for pulling a bill or check in accordance with an embodiment of the present invention.

An apparatus for pulling a paper medium, i.e., a bill or check 10 is provided on an upper portion of the cassette module 750.

The apparatus 10 includes a transfer roller unit 12 which includes a pair of rollers 12 disposed at a position corresponding to the inlet port 712 of the casing body 710 and transfers a paper medium 55 introduced through the inlet port 712 and a transfer belt unit 20 which is horizontally provided to transfer the paper medium 55 that has passed through the transfer rollers 12 towards the rear of the casing body 710. The apparatus 10 may further include an actuator, which may be a stepping motor, for driving the belt unit 20.

The transfer belt unit 20 includes a front pulley 22, a rear pulley 24, and a transfer belt 30 which is wrapped around the front and rear pulleys 22 and 24. The front pulley 22 is coaxial with a drive roller 14. When the paper medium 55 enters the apparatus 10, the front pulley 22 is rotated by the actuator.

The drive roller 14 is put in contact with a pinch roller 16 and a stack roller 18, thus forming a clamping roller unit 50.

A detecting sensor 52 is installed between the transfer roller unit 12 and the clamping roller unit 50 so as to detect whether a front end of the paper medium 55 that has passed through the transfer roller unit 12 has entered the clamping roller unit 50.

First and second elastic clamps 40 and 42 are respectively attached on the transfer belt 30 at positions spaced apart from each other by a predetermined distance. When each elastic clamp 40, 42 which has been closed at a front end thereof passes over the drive roller 14, the front end of the elastic clamp 40, 42 is open in a section in which the curvature of the transfer belt 30 increases. After the elastic clamp 40, 42 has passed over the drive roller 14, the elastic clamp 40, 42 returns to its original state by its own elasticity. As such, while each elastic clamp 40, 42 passes through the clamping roller unit 50, that is, passes over the drive roller 14, the front end thereof is open. After the elastic clamp 40, 42 has passed through the clamping roller unit 50, the front end thereof closes under its own elasticity. That is, clamping begins at the center of the clamping roller unit 50.

The front end of the paper medium 55 that has passed through the transfer roller unit 12 is inserted into the open front end of the elastic clamp 40 or 42 while it passes through the drive roller 14 and the pinch roller 16 of the clamping roller unit 50. The elastic clamp 40 or 42 clamps the front end of the paper medium 55 and then comes out of the clamping roller unit 50. Subsequently, as the transfer belt 30 rotates, the elastic clamp 40 or 42 that has clamped the front end of the paper medium 55 is pulled and moved to the rear of the check storage cassette 740. When the elastic clamp 40 or 42 passes over the rear pulley 24, the front end of the elastic clamp 40 or 42 is open so that the front end of the paper medium 55 is released from the elastic clamp 40 or 42. Preferably, a separation stopper 70 is provided adjacent to the rear pulley 24 so that when the front end of the paper medium that has been pulled by the elastic clamp 40 or 42 is released from the elastic clamp, the separation stopper 70 colloids with and blocks the paper medium 55, thus facilitating the separation of the paper medium 55 from the elastic clamp 40 or 42.

A stack wheel 60 is provided under the front pulley 22. The stack wheel 60 strikes a rear end of the paper medium 55 that is being pulled to the rear of the casing body 710, so that the paper medium 55 can be correctly stacked, thus making it possible to reduce the size of the check storage cassette.

Typically, there are different sizes of checks that range from comparatively short ones which are from 115 mm to 185 mm to long ones which are 230 mm in size. Because of this, the embodiment is designed based on alignment with the rear end of the largest check.

When a first paper medium has been completely clamped by the first elastic clamp 40 and the position of the second elastic clamp 42 is at a predetermined position, a second paper medium that is next in terms of sequential input must be standing by on the transfer roller unit 12.

A plurality of holes, in this embodiment, three holes including a first hole 32, a second hole 34 and a third hole 36 are formed at regular intervals in each of the upper and lower parts of the transfer belt 30 (see, FIG. 4).

A prism sensor unit 80 includes a light emitting part 82, a light receiving part 84 and a prism 86. The prism 86 is provided beneath the transfer belt 30, and the light emitting part 82 and the light receiving part 84 are provided above the transfer belt 30 on the opposite side of the prism 86. The prism sensor unit 80 creates a sensing signal in associated with the holes 32, 34 and 36 to control the elastic clamps 40 and 42 such that they are disposed at the predetermined positions.

For instance, if light emitted from the light emitting part 82 is reflected from the prism 86 and then sensed by the light receiving part 84 through the second hole 34 which is behind the first hole 32, to put it another way, when the transfer belt 30 approaches to a predetermined position of the clamping roller unit 50 in which the paper medium 55 can be clamped, the speed at which the transfer belt 30 rotates is reduced. After the transfer belt 30 has been operated for a while longer, if light emitted from the light emitting part 82 is reflected from the prism 86 and then sensed by the light receiving part 84 through the third hole 36 which is behind the second hole 34, to put it another way, when the transfer belt 30 arrives at the predetermined position of the clamping roller unit 50, the transfer belt 30 stops so that either clamp 40 or 42 at the predetermined position can clamp the paper medium 55.

As such, in the pulling method of the embodiment, when a paper medium that has been introduced into the inlet port 712 passes through the transfer roller unit 12, the detecting sensor 52 senses the paper medium and forces the paper medium to temporarily stand by.

Thereafter, when the transfer belt 30 is operated and approaches to the predetermined position, the speed at which the transfer belt 30 rotates is reduced. After the transfer belt 30 has been operated for a while longer, when the transfer belt 30 arrives at the predetermined position, either clamp 40 or 42 on the transfer belt 30 stops at the predetermined position of the clamping roller unit 50.

Subsequently, the paper medium that is standing by is transferred to the clamping roller unit 50 and received in or clamped by the clamp 40 or 42 at the predetermined position. The transfer belt 30 is thereafter operated to transfer the paper medium received in the clamp toward the storage cassette, so that the paper medium is stacked on the top another in the storage cassette.

While the paper medium received in the clamp 40 or 42 is transferred, a subsequent paper medium to be introduced is transferred to the inlet port 712.

In the apparatus for use in the bundle bill and check acceptor according to the embodiment having the above-mentioned construction, when the detecting sensor 52 senses that the front end of a paper medium that has passed through the transfer roller unit 12 has entered the clamping roller unit 50, one of the elastic clamps 40 and 42 on the transfer belt 30 slews up to clamp the front end of the paper medium that is being received in the check or bill storage cassette and pulls it to a predetermined position in the check or bill cassette, that is, to a regular position at which it is detected by a clamp position sensor (not shown). Thereafter, the elastic clamp 40 or 42 slews down to release the paper medium at that position so that the paper medium falls down. The apparatus thereafter waits for the entrance of a subsequent paper medium. Meanwhile, the apparatus of the embodiment pushes downwards the rear end of the paper medium that has been clamped by the stack wheel, thus preventing a jam from occurring, thereby enhancing the reliability of the device.

While the invention has been shown and described with respect to the embodiments of the electrode system for cranial nerve stimulation, the present invention is not limited thereto. It will be understood by those skilled in the art that various changes and modifications may be made without departing from the scope of the invention as defined in the following claims.

What is claimed is:

1. An apparatus for pulling a bill or a check into a storage cassette of a bundle bill and check acceptor, comprising:

a transfer roller unit configured to vertically transfer a paper medium into an inlet port of the storage cassette;

a transfer belt unit comprising a transfer belt and a stack wheel, the transfer belt configured to horizontally transfer the paper medium to a rear portion of the storage cassette, the transfer belt formed with at least two holes;

a clamping roller unit configured to clamp a front end of the paper medium vertically transferred through the inlet port depending on movement of the transfer belt unit, the stack wheel configured to strike a rear end of the clamped paper medium; and elastic clamps provided on the transfer belt at positions spaced apart from each other by a predetermined distance, each of the elastic clamps configured to open an end to clamp and pull the front end of the paper medium vertically introduced through the inlet port when each of the elastic clamp is passing through the clamping roller unit, each of the elastic clamps further configured to release the paper medium at the rear portion of the storage cassette to stack the paper medium on top of another paper medium in the storage cassette; and a prism sensor unit including a light emitting part and a light receiving part, the light emitting part and the light receiving part located relative to the at least two holes of the transfer belt to detect locations of the elastic clamps relative to the clamping roller unit.

2. The apparatus of claim 1, wherein the transfer belt unit comprises a separation stopper configured to block the front end of the paper medium for release at the rear portion of the storage cassette to cause the paper medium to drop into the storage cassette.

3. The apparatus of claim 1, wherein when the paper medium is clamped by one of the elastic clamps, a subsequent paper medium waits for transfer by the transfer roller unit.

4. The apparatus of claim 1, further comprising:

a detecting sensor provided between the transfer roller unit and the clamping roller unit, the detecting sensor configured to detect entrance of the paper medium into the storage cassette.

* * * * *